US011879100B2

(12) United States Patent
Murugesan et al.

(10) Patent No.: US 11,879,100 B2
(45) Date of Patent: Jan. 23, 2024

(54) REMOVING CATALYST FINES FROM HEAVY OILS

(71) Applicant: Baker Hughes Oilfield Operations LLC, Houston, TX (US)

(72) Inventors: Sankaran Murugesan, Katy, TX (US); Sai Reddy Pinappu, Sugar Land, TX (US); Jerry J. Weers, Richmond, TX (US); Carl E. Weaver, Conroe, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/732,335

(22) Filed: Apr. 28, 2022

(65) Prior Publication Data

US 2023/0348794 A1 Nov. 2, 2023

(51) Int. Cl.

| | |
|---|---|
| ***C10G 29/20*** | (2006.01) |
| ***C10G 31/06*** | (2006.01) |
| ***C10G 31/09*** | (2006.01) |
| ***C10G 29/02*** | (2006.01) |
| ***C10G 29/22*** | (2006.01) |
| ***C10G 31/10*** | (2006.01) |
| ***C10L 1/14*** | (2006.01) |

(52) U.S. Cl.

CPC ..... *C10G 29/20* (2013.01); *C10G 31/06* (2013.01); *C10G 31/10* (2013.01); *C10L 1/146* (2013.01); *C10G 2300/107* (2013.01); *C10G 2300/1074* (2013.01); *C10G 2300/1077* (2013.01); *C10G 2300/201* (2013.01); *C10G 2300/80* (2013.01)

(58) Field of Classification Search

None

See application file for complete search history.

(56) References Cited

U.S. PATENT DOCUMENTS

| | | | | |
|---|---|---|---|---|
| 5,525,201 | A * | 6/1996 | Diaz-Arauzo | C10G 33/04 210/708 |
| 7,410,456 | B2 | 8/2008 | Wase | |
| 9,714,909 | B2 | 7/2017 | Jensen et al. | |
| 2004/0062989 | A1 * | 4/2004 | Ueno | C09D 133/16 264/319 |
| 2006/0000787 | A1 | 1/2006 | Galasso et al. | |
| 2009/0120836 | A1 | 5/2009 | Weber | |
| 2014/0296594 | A1 * | 10/2014 | Brok | C10G 11/18 585/310 |
| 2015/0191660 | A1 | 7/2015 | Englund | |
| 2020/0123458 | A1 | 4/2020 | Moore et al. | |
| 2021/0261874 | A1 | 8/2021 | Eller et al. | |

FOREIGN PATENT DOCUMENTS

| | | | |
|---|---|---|---|
| WO | 2020069959 | A1 | 4/2020 |

OTHER PUBLICATIONS

"How to Prevent Damage in Marine Fuel Systems From Cat Fines," https://blog.parker.com/site/usa/en-US/details-home-page/how-to-prevent-damage-in-marine-fuel-systems-from-cat-fines-us, Jul. 8, 2019, 7pp.

* cited by examiner

*Primary Examiner* — Tam M Nguyen

(74) *Attorney, Agent, or Firm* — Crowe & Dunlevy, P.C.

(57) ABSTRACT

Catalyst fines can be removed from heavy oils, such as marine fuel oils, by introducing an additive in an effective amount to at least partially remove the catalyst fines, where the additive is an oxyalkylated acid-catalyzed alkylphenol formaldehyde resin and/or a Mannich condensate base resin copolymer.

12 Claims, 1 Drawing Sheet

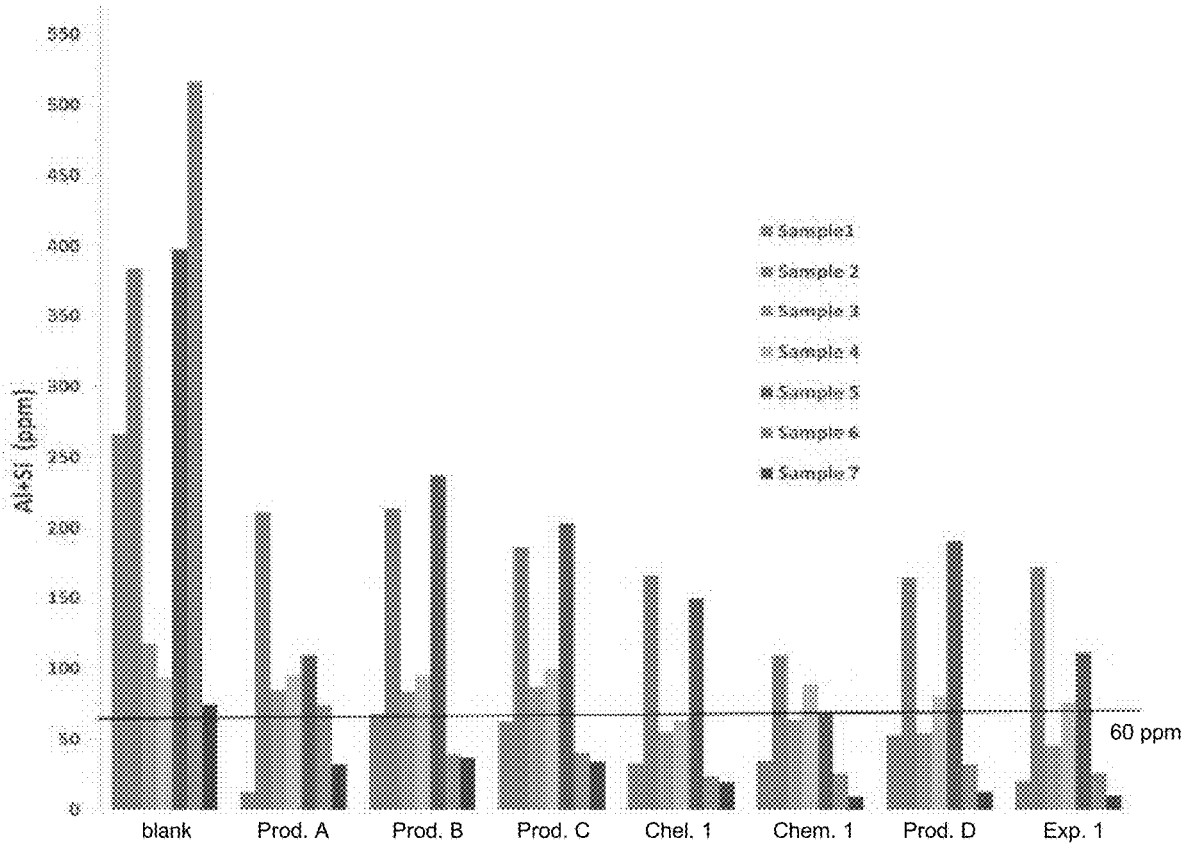
Al+Si (ppm)
0
50
100
150
200
250
300
350
400
450
500
550
Sample1
Sample 2
Sample 3
Sample 4
Sample 5
Sample 6
Sample 7
60 ppm
blank
Prod. A
Prod. B
Prod. C
Chel. 1
Chem. 1
Prod. D
Exp. 1

REMOVING CATALYST FINES FROM HEAVY OILS

TECHNICAL FIELD

The present invention relates to methods and compositions for removing catalyst fines from oils, and more particularly relates to methods and compositions for at least partially removing catalyst fines from heavy oils, such as marine fuel oils.

BACKGROUND

Catalytic fines (catalyst fines or "cat fines") are typically hard, solid aluminum and silicon oxide particles that are normally present in heavy fuel oil. For refineries relying on catalytic cracking, cat fines are added to the crude oil to enhance low temperature fuel cracking. However, downstream in the heavy fuel oil for marine application, increased amounts of cat fines will damage the fuel injection equipment. ISO Standard 8217:2012 introduced a maximum permissible 60-ppm level of cat fines, expressed as aluminum+silicon, for marine residual fuels, a reduction from the 80 ppm levels in ISO 8217:2005. The level of 60 ppm Al+Si is maintained in the latest published ISO 8217:2017 Fuel Standard.

The fines are solid particles of spent aluminum and silicon catalyst that arise from the catalytic cracking process in the refinery. The fines are in a form of complex aluminosilicates and, depending on the catalyst used, vary both in size and in hardness. To remove the cat fines, commonly gravity settling tanks are used since cat fines have a higher density than the fuel oil medium they are contained within. Most of the time these settling approaches do meet the specification of 60 ppm Al+Si due to the nature of the particles present. Other known physical techniques of removing fines include filtration and centrifugation. However, these spent cat fines undergo thermal and chemical changes during the operations as they are coated with thick organic layers that causes them to be suspended in the organic medium. Therefore, a different approach can be needed to remove the fines from the heavy oil in which they are suspended.

It is thus desirable to improve the ability to remove and separate catalyst fines from oils containing them, and in particular to remove and separate catalyst fines from heavy oils such as marine fuel oils and the like.

SUMMARY

There is provided, in one form, a method for at least partially removing catalyst fines from a heavy oil containing them, where the method includes introducing an additive into the heavy oil containing catalyst fines in an effective amount to at least partially remove the catalyst fines, where the additive includes an oxyalkylated acid-catalyzed alkylphenol formaldehyde resin and/or a Mannich condensate base resin copolymer; and then at least partially removing the catalyst fines from the heavy oil by a physical process.

Additionally, there may be provided in a non-limiting embodiment, a treated heavy oil stream that includes heavy oil, catalyst fines, and an additive in an effective amount to at least partially remove the catalyst fines from the heavy oil, where the additive includes an oxyalkylated acid-catalyzed alkylphenol formaldehyde resin and/or a Mannich condensate base resin copolymer.

BRIEF DESCRIPTION OF THE DRAWING

FIG. 1 is a graph showing the results of using various additives to at least partially remove Al+Si catalyst fines from seven different fuel oils, along with a blank that had no additive introduced thereto.

DETAILED DESCRIPTION

A novel chemical approach has been discovered that selectively targets organically coated suspended catalyst fines which facilitates them settling in a conventional gravity settling process. The chemistry includes, but is not limited to an alkyl acid catalyzed resin having different concentration of ethylene oxide (EO) and propylene oxide (PO) moieties. The presence of EO and PO enables them to disperse in the organic matrix and bind to the organically coated dispersed cat fines in the heavy fuel oil.

It is expected that the methods and additives described herein are useful for at least partially removing catalyst fines from heavy oils such as marine fuels, refinery residua, decant oil, and combinations thereof. Decant oil is the heaviest bottoms stream from a fluid catalytic cracker (FCCU). It is a blend component of the marine fuel with the resid. It will be understood that the methods and additives described herein are not addressed to fluids such as lubricating oils for diesel engines, which are mostly paraffinic in nature, such as mineral oils (whether or not synthetic), as well as animal oils and vegetable oils, with or without additives, which are widely used in industry for various purposes such as lubrication, cooling, and insulation, in contrast to fuel. In contrast, the heavy oils of the present method contain components including, but not necessarily limited to, saturates, aromatics, resins, and/or asphaltenes.

It will also be appreciated that while complete removal of cat fines is certainly desirable, it is not necessary that complete removal of cat fines occur for the method and additives to be considered successful. Partial removal of cat fines is an indication of a successful method, particularly when the removal is improved or greater than that possible when conventional additives are employed.

In one non-limiting embodiment a suitable additive is an oxyalkylated acid-catalyzed alkylphenol formaldehyde resin, referred to in shorthand as "Chemistry 1" or "Chem. 1". Suitable acid-catalyzed resins include, but are not necessarily limited to, alkoxylated p-t-alkyl phenol resins where the alkyl group is selected from the group consisting of methyl, ethyl, propyl, butyl, and combinations thereof. Also suitable are resins of formula (I):

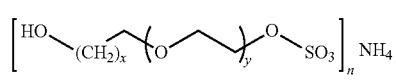

(I)

where x ranges from 1 to 12, y ranges from 1 to 300, and n is such that the weight average molecular weight ranges from about 100 to about 15000 molecular weights. Other suitable resins are those of formula (II):

(II)

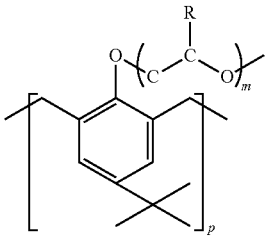

where R is hydrogen or methyl, m ranges from 1 to 100, and p ranges from 1 to 50.

With respect to the oxyalkylene moiety, in one non-limiting embodiment there can be from 0.1 independently to 20 total moles of EO and/or PO per phenolic group in the acid catalyzed resin (ACR); alternatively, from 0.5 to 5.0 total moles of EO and/or PO per phenolic group. When the term "independently" is used herein with respect to a range, it means that any threshold may be used together with another threshold to give a suitable alternative range. For example, in this case a suitable ratio of total moles of EO and/or PO to phenolic group can be from 0.1 to 5.0 mole ratio as a suitable alternative mole ratio range. The ratio of PO to EO can vary from 10 mol % to 50 mol %. The oxide can be made by stepwise oxyalkylation (for example, adding PO, then adding EO) or by mixing the oxides and then conducting the phenolic group oxyalkylation to give a more random distribution of PO and EO groups in the Chem. 1 resins.

While in one non-restrictive version, a suitable Chem. 1 resin is a butyl ACR, but in another non-limiting embodiment the alkyl group can have from 1 to 28 carbon atoms, and may be a branched or linear alkyl group. In a non-limiting embodiment, the alkyl group can be ethyl, propyl, butyl, hexyl, etc.

In another non-restrictive version, the acid catalyst resin is a polymer containing formula (III) groups as the repeating unit:

(III)

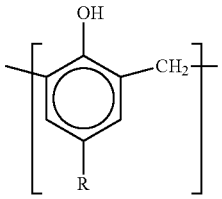

In another non-limiting embodiment, the molecular weight of the Chem. 1 polymer ranges between about 2,000 independently to about 10,000 grams/mole; alternatively, between about 3,000 independently to about 5,000 grams/mole.

When Chem. 1 is used alone, a suitable dosage based on the heavy oil ranges from about 10 ppm independently to about 10,000 ppm; alternatively, from about 100 ppm independently to about 1,000 ppm.

The other suitable additive to at least partially remove cat fines from heavy oil, used alone or optionally together with Chem. 1 is a Mannich condensate base resin copolymer, or for shorthand "Chelant 1" or "Chel. 1". In one non-limiting embodiment, Chelant 1 is a Mannich condensate base resin copolymer of nonyl phenol, formaldehyde, and ethylene diamine (EDA). However, it is also suitable that the phenol has an alkyl group ranging from 1 to 28 carbon atoms that is linear or branched. Suitable amines include polyethyleneamines having from 1 to 5 amine groups; in one non-restrictive version, tetraethylenepentamine. The mole ratio of phenol to amine may range from 1:1 to 1:5. To be clear, Chelant 1 is different from Chemistry 1; for instance, Chelant 1 is not oxyalkylated.

When Chel. 1 is used alone, a suitable dosage based on the heavy oil ranges from about 10 ppm independently to about 10,000 ppm; alternatively, from about 100 ppm independently to about 1,000 ppm.

In the case where both Chem. 1 and Chel. 1 are used together in a mixture or blend, a suitable dosage for the combination based on the heavy oil ranges from about 10 ppm independently to about 10,000 ppm; alternatively, from about 100 ppm independently to about 1,000 ppm. The weight ratio of Chem. 1 to Chel. 1 in these mixtures or blends ranges from about 10/90 independently to about 90/10; alternatively, from about 45/55 independently to about 55/45; and in another non-restrictive version the weight ratio can be about 1/1.

In the method for at least partially removing cat fines from the heavy oil, the heavy oil should be fluid for it to be processed and handled. An elevated temperature lowers the viscosity of heavy oils, which facilitates enhanced treatment performance through better distribution of the treatment in the bulk oil continuous phase. In one non-limiting embodiment, the heavy oil is at a temperature from about 2° C. independently to about 250° C.; alternatively, from about 20° C. independently to about 120° C. There is no particular or critical way of introducing the additives into the heavy oil. Good dispersion of the additive into the heavy oil is helpful.

The invention will be further described with respect to the following Examples, which are not meant to limit the invention, but rather to further illustrate some embodiments.

EXAMPLES

In the following Examples, seven different fuel oils were tested to identify better chemistry to meet the specification of 60 ppm (Al+Si) for ISO 8217. The physical properties of each of the fuel oils (Feeds 1-7) is presented in Table I. It will be appreciated that heavy oils can differ markedly from each other, and that not all additives will work equally well in all heavy oils.

TABLE I

Physical Properties of Feed Fuel Oils

| Items | Properties | 1 | 2 | 3 | 4 | 5 | 6 | 7 |
|---|---|---|---|---|---|---|---|---|
| Basic Properties | Filterable Solids (ppm) | 3870 | 1730 | <19 | 235 | 1580 | 9898 | 399 |
| Components | Saturate (wt %) | 42.6 | 46.2 | 60.6 | 96.6 | 48.4 | 33 | 55.8 |
| | Aromatic (wt %) | 57.4 | 53.8 | 39.4 | 3.4 | 51.6 | 67 | 44.2 |

TABLE I-continued

| Physical Properties of Feed Fuel Oils | | | | | | | | |
|---|---|---|---|---|---|---|---|---|
| Items | Properties | 1 | 2 | 3 | 4 | 5 | 6 | 7 |
| | Resin (wt %) | 14.09 | 8.88 | 8.21 | 4.33 | 17.95 | 10.03 | 15.16 |
| | Asphaltene (wt %) | 3.56 | 1.69 | 1.13 | 0.59 | 4.59 | 1.46 | 5.06 |
| | Total Acid Number (TAN) | 0.581 | 0.049 | 0.636 | 3.55 | 0.154 | 0.529 | 0.161 |
| | Water Content (vol %) | 0.4 | 0 | 0 | 0.4 | 2 | 0.8 | 0.8 |
| | Sludge (vol %) | 0.4 | 0.8 | 0.8 | 0 | 0.8 | 0.4 | 0.4 |
| | BS&W (vol %) | 0.8 | 0.8 | 0.8 | 0.4 | 2.8 | 1.2 | 1.2 |
| | Total Amine Value (TAV) mg KOH/g | 0.879 | 0.75 | 0.461 | <0.05 | 2.16 | 0.381 | 2.41 |
| | Total Amine Value (TAV) as N | 219 | 187 | 115 | <10 | 540 | 95.1 | 601 |
| | Al (ppm) | 167.9 | 270.6 | 60.1 | 19.5 | 281.6 | 329.6 | 53.1 |
| | Si (ppm) | 98.1 | 113.6 | 57.6 | 74.1 | 116.1 | 186.9 | 21.7 |
| | Al + Si (ppm) | 266 | 384.2 | 117.7 | 93.6 | 397.7 | 516.5 | 74.8 |

All of the Examples were conducted at 93° C. In all Examples the additive dosage was 500 ppm based on the heavy oil. The additives used were as noted in Table II.

TABLE II

| Additives | |
|---|---|
| Prod. A | Commercial product: Crosslinked polyol ester with alkyl benzenesulfonic acid in an aromatic solvent |
| Prod. B | Commercial product: Formaldehyde, polymer with dinonylphenol, nonylphenol, and oxirane |
| Prod. C | Commercial product: 40% aqueous ferrous chloride |
| Prod. D | Commercial product: Blend containing 50 wt % of an oxyalkylated (6 mole EO per phenol group) nonylphenol/formaldehyde resin with 3 wt % of an oxyalkylated acid catalyzed t-butylphenol/formaldehyde resin in aromatic solvent |
| Chel. 1 | Oxyalkylated acid catalyzed butyl phenol/formaldehyde resin |
| Chem. 1 | Mannich condensate base resin copolymer of nonyl phenol, formaldehyde, and ethylene diamine |
| Exp. 1 | 50/50 weight ratio of Chel. 1 + Chem. 1 |

The results of adding the indicated additive in the indicated heavy oil are presented in FIG. 1. The results show that Chem. 1 and Chel. 1 and the combination chemistry of Exp. 1 (Chem. 1+Chel. 1) were able to meet the specification of most of the fuels tested in these experiments. Indeed, the inventive additives of Chem. 1, Chel. 1, and Exp. 1 generally outperformed the conventional, commercial Products A, B, C, and D. The ISO 8217 specification of 60 ppm cat fines (Al+Si) is shown by the horizontal line in FIG. 1, and thus these treated feeds with cat fines below 60 ppm would be suitable for marine fuel applications. Without desiring to be limited to any particular mechanism or explanation, it is believed that Chem. 1 and/or Chel. 1 disperses into the organic matrix around the coated cat fines and binds to them to enable them to be more easily removed by settling or other known physical process.

In the foregoing specification, the invention has been described with reference to specific embodiments thereof. However, it will be evident that various modifications and changes can be made thereto without departing from the broader scope of the invention as set forth in the appended claims. Accordingly, the specification is to be regarded in an illustrative rather than a restrictive sense. For example, different heavy oils, alkylphenol formaldehyde reins, copolymers, polymers, alkylene oxides and ratios thereof, alkyl phenols, aldehydes, polyamines, chelants, proportions, molar ratios, dosages, temperatures, physical separation processes, catalyst fines, and amounts not specifically identified or described in this disclosure or not evaluated in a particular Example are still expected to be within the scope of this invention.

The present invention may suitably comprise, consist or consist essentially of the elements disclosed and may be practiced in the absence of an element not disclosed. For instance, there is provided a method for at least partially removing catalyst fines from a heavy oil containing them, where the method comprises, consists essentially of, or consists of introducing an additive into the heavy oil containing catalyst fines in an effective amount to at least partially remove the catalyst fines, where the additive is selected from the group consisting of an oxyalkylated acid-catalyzed alkylphenol formaldehyde resin and/or a Mannich condensate base resin copolymer, and subsequently at least partially removing the catalyst fines from the heavy oil by a physical process.

There may be additionally provided a treated heavy oil stream comprising, consisting essentially of, and consisting of heavy oil; catalyst fines; and an additive in an effective amount to at least partially remove the catalyst fines from the heavy oil, where the additive is selected from the group consisting of an oxyalkylated acid-catalyzed alkylphenol formaldehyde resin and/or a Mannich condensate base resin copolymer.

The words "comprising" and "comprises" as used throughout the claims, are to be interpreted to mean "including but not limited to" and "includes but not limited to", respectively.

As used herein, the singular forms "a," "an," and "the" are intended to include the plural forms as well, unless the context clearly indicates otherwise.

As used herein, the term "about" in reference to a given parameter is inclusive of the stated value and has the meaning dictated by the context (e.g., it includes the degree of error associated with measurement of the given parameter).

As used herein, the term "and/or" includes any and all combinations of one or more of the associated listed items.

What is claimed is:

1. A method for at least partially removing catalyst fines from a heavy oil containing them, the method comprising:

introducing an additive into the heavy oil containing catalyst fines in an effective amount to at least partially remove the catalyst fines, where the additive is selected from the group consisting of:

an oxyalkylated acid-catalyzed alkylphenol formaldehyde resin;

a Mannich condensate base resin copolymer; and combinations thereof; and at least partially removing the catalyst fines from the heavy oil by a physical process.

2. The method of claim 1 where the alkyl phenol in either or both of the oxyalkylated acid-catalyzed alkylphenol formaldehyde resin and the Mannich condensate base resin copolymer has from 1 to 28 carbon atoms where the total moles of alkylene oxide ranges from about 0.1 to about 20 moles per mole of alkyl phenol group in the resin, where the alkylene oxide is selected from the group consisting of ethylene oxide and propylene oxide.

3. The method of claim 1 where the additive is the oxyalkylated acid-catalyzed alkylphenol formaldehyde resin, and the molecular weight of the oxyalkylated acid-catalyzed alkylphenol formaldehyde resin ranges from about 2,000 to about 10,000 grams/mole.

4. The method of claim 1 where the additive is the Mannich condensate base resin copolymer, and the Mannich condensate base resin copolymer comprises the reaction of an alkylphenol with an amine, and formaldehyde and where the amine is a polyalkyleneamine having 2 to 5 amino groups therein.

5. The method of claim 1 where the additive is the oxyalkylated acid-catalyzed alkylphenol formaldehyde resin, and where the oxyalkylated acid-catalyzed alkylphenol formaldehyde resin is selected from the group consisting of:

alkoxylated p-t-alkyl phenol resins where the alkyl group is selected from the group consisting of methyl, ethyl, propyl, butyl, and combinations thereof;

resins of formula (I):

(I)

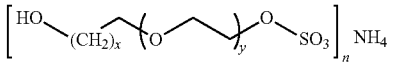

where x ranges from 1 to 12, y ranges from 1 to 300, and n is such that the weight average molecular weight ranges from about 100 to about 15,000;

resins of formula (II):

(II)

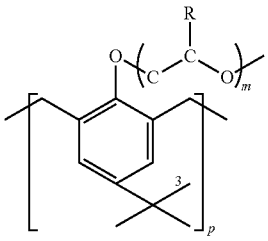

where R is hydrogen or methyl, m ranges from 1 to 100, and p ranges from 1 to 50.

6. The method of claim 1 where the additive is the Mannich condensate base resin copolymer, where the Mannich condensate base resin copolymer is made by reacting an alkyl phenol with an amine and formaldehyde, where:

the alkyl group on the alkyl phenol ranges from C1 to C28;

the amine is a polyethyleneamine having from 1 to 5 amine groups; and where the molar ratio of alkyl phenol to polyethyleneamine ranges from 1:1 to 1:5.

7. The method of claim 1 where the heavy oil is selected from the group consisting of marine fuels, refinery residua, decant oil, and combinations thereof.

8. The method of claim 1 where the effective amount of the additive based on the heavy oil ranges from about 10 ppm to about 10,000 ppm.

9. The method of claim 1 where both the oxyalkylated acid-catalyzed alkylphenol formaldehyde resin and the Mannich condensate base resin copolymer are introduced, and the weight ratio between the oxyalkylated acid-catalyzed alkylphenol formaldehyde resin and the Mannich condensate base resin copolymer ranges from about 10/90 to about 90/10.

10. The method of claim 1 where the heavy oil is at a temperature from about 2° C. to about 250° C.

11. The method of claim 1 where the physical removal process is selected from the group consisting of gravity settling, centrifugation, and combinations thereof.

12. The method of claim 1 where the catalyst fines comprise aluminum and silicon.

* * * * *